US009864298B2

(12) United States Patent
Shimizu et al.

(10) Patent No.: US 9,864,298 B2
(45) Date of Patent: Jan. 9, 2018

(54) DEVELOPING DEVICE AND IMAGE FORMING APPARATUS INCLUDING THE SAME

(71) Applicant: KYOCERA Document Solutions Inc., Osaka-shi, Osaka (JP)

(72) Inventors: Tamotsu Shimizu, Osaka (JP); Yasuhiro Tauchi, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/480,473

(22) Filed: Apr. 6, 2017

(65) Prior Publication Data

US 2017/0299977 A1 Oct. 19, 2017

(30) Foreign Application Priority Data

Apr. 14, 2016 (JP) ..... 2016-080734

(51) Int. Cl.
*G03G 15/09* (2006.01)
*G03G 15/08* (2006.01)

(52) U.S. Cl.
CPC ..... *G03G 15/0812* (2013.01); *G03G 15/0889* (2013.01); *G03G 15/0928* (2013.01)

(58) Field of Classification Search
CPC ..... G03G 15/0812; G03G 15/0889; G03G 15/0928; G03G 15/0921; G03G 2215/0609
USPC ..... 399/267, 277
See application file for complete search history.

(56) References Cited

U.S. PATENT DOCUMENTS

2001/0019675 A1* 9/2001 Masuda ..... G03G 15/0921 399/277
2010/0196045 A1* 8/2010 Kabashima ..... G03G 15/0921 399/104
2012/0251189 A1* 10/2012 Oba ..... G03G 15/065 399/270
2013/0243489 A1* 9/2013 Sakamaki ..... G03G 15/0889 399/254
2015/0010335 A1* 1/2015 Akita ..... G03G 15/0812 399/274

(Continued)

FOREIGN PATENT DOCUMENTS

JP 05-002341 1/1993

*Primary Examiner* — Sophia S Chen
(74) *Attorney, Agent, or Firm* — Gerald E. Hespos; Michael J. Porco; Matthew T. Hespos

(57) ABSTRACT

A developing device includes a housing, a developing roller, a developer stirring member, and a layer thickness regulating member. The developing roller includes a stationary magnet and a sleeve. The stationary magnet includes a first magnetic pole having a specific polarity, and a second magnetic pole lying downstream of the first magnetic pole and having the same polarity as the first magnetic pole. In an entire inter-pole region between the first magnetic pole and the second magnetic pole, the stationary magnet produces a magnetic force including a horizontal component that keeps the specific polarity and has a value greater than zero (mT). The inter-pole region includes a flat area where a horizontal magnetic force component having a minimum absolute value exits and the horizontal magnetic force component changes within a range of 0.5 (mT) or less, the flat area extending over a range of 10 degrees or more.

7 Claims, 12 Drawing Sheets

(56) References Cited

U.S. PATENT DOCUMENTS

| | | | | |
|---|---|---|---|---|
| 2015/0253690 | A1* | 9/2015 | Ishida | G03G 15/0812 399/276 |
| 2015/0362864 | A1* | 12/2015 | Suzuki | G03G 15/0928 399/276 |
| 2016/0091830 | A1* | 3/2016 | Furukawa | G03G 15/0921 399/104 |

* cited by examiner

DEVELOPING DEVICE AND IMAGE FORMING APPARATUS INCLUDING THE SAME

INCORPORATION BY REFERENCE

This application is based on Japanese Patent Application No. 2016-080734 filed with the Japan Patent Office on Apr. 14, 2016, the contents of which are hereby incorporated by reference.

BACKGROUND

The present disclosure relates to a developing device and an image forming apparatus including the same.

Conventional image forming apparatuses employing an electrophotographic method, such as a printer and a copier, include a photoconductive drum for carrying an electrostatic latent image, a developing device for supplying toner to the photoconductive drum to develop the electrostatic latent image into a toner image, and a transfer device for transferring the toner image from the photoconductive drum onto a sheet.

The developing device includes a developing roller for supplying toner to the photoconductive drum. The developing roller includes a stationary magnet having a plurality of magnetic poles, and a sleeve rotatable around the magnet. In a two-component developing method, developer containing toner and magnetic carrier is carried on the sleeve of the developing roller. In such a developing roller, it is necessary to separate developer from the developing roller after the supply of toner to the photoconductive drum.

There are conventionally known techniques that use repelling magnetic fields produced by adjacent like poles to separate developer from a developing roller. There is also known a technique in which a pair of south poles and a pair of north poles are successively arranged in a circumferential direction in order to allow developer to pass over each pair of adjacent like poles on the developer roller.

SUMMARY

A developing device according to the present disclosure includes a housing, a developing roller, a developer stirring member, and a layer thickness regulating member. The housing contains developer including toner and magnetic carrier. The developing roller includes a stationary magnet having a plurality of magnetic poles arranged in a circumferential direction, and a sleeve rotatable around the stationary magnet in a predetermined rotational direction and having a circumferential surface for carrying developer thereon. The developing roller is supported on the housing, while facing a photoconductive drum having a surface for allowing an electrostatic latent image to be formed thereon at a predetermined developing position, to supply toner to the photoconductive drum. The developer stirring member is rotatably supported on the housing, and operable to stir developer and supply developer to the developing roller. The layer thickness regulating member is disposed opposite to the sleeve of the developing roller for regulating the layer thickness of developer supplied to the developing roller by the developer stirring member. The stationary magnet includes a first magnetic pole lying downstream of the developing position in the rotational direction and having a specific polarity, and a second magnetic pole lying downstream of the first magnetic pole in the rotational direction and having the same polarity as the first magnetic pole, the second magnetic pole producing a magnetic field that allows the sleeve to receive developer supplied by the developer stirring member. In an entire inter-pole region (IE) between a maximum vertical component position of a magnetic force of the first magnetic pole and a maximum vertical component position of a magnetic force of the second magnetic pole, the stationary magnet produces a magnetic force including a horizontal component that keeps the specific polarity and has a value greater than zero (mT). The inter-pole region includes a flat area where a horizontal magnetic force component having a minimum absolute value exits and the horizontal magnetic force component changes within a range of 0.5 (mT) or less, the flat area extending over a range of 10 degrees or more in a rotational angle of the sleeve. When the maximum vertical magnetic force component of the first magnetic pole is A (mT), the half width of the vertical magnetic force component of the first magnetic pole is θ (degrees), the maximum vertical magnetic force component of the second magnetic pole is B (mT), and the half width of the vertical magnetic force component of the second magnetic pole is φ (degrees), the following relationship is satisfied:

$$2 \leq (B \times \varphi)/(A \times \theta) \leq 5.$$

An image forming apparatus according to another aspect of the present disclosure includes the above-described developing device, the above-mentioned photoconductive drum for receiving toner from the developing device and having the surface for carrying a toner image thereon, and a transfer section for transferring the toner image onto a sheet from the photoconductive drum.

These and other objects, features and advantages of the present disclosure will become more apparent upon reading the following detailed description along with the accompanying drawings.

DETAILED DESCRIPTION

Hereinafter, an image forming apparatus 10 according to an embodiment of the present disclosure will be described in detail with reference to the accompanying drawings. In the present embodiment, a tandem color printer is described as an example of the image forming apparatus. The image forming apparatus may alternatively be provided as a copier, a facsimile apparatus or a multifunctional apparatus equipped with these functions.

Figure 1:
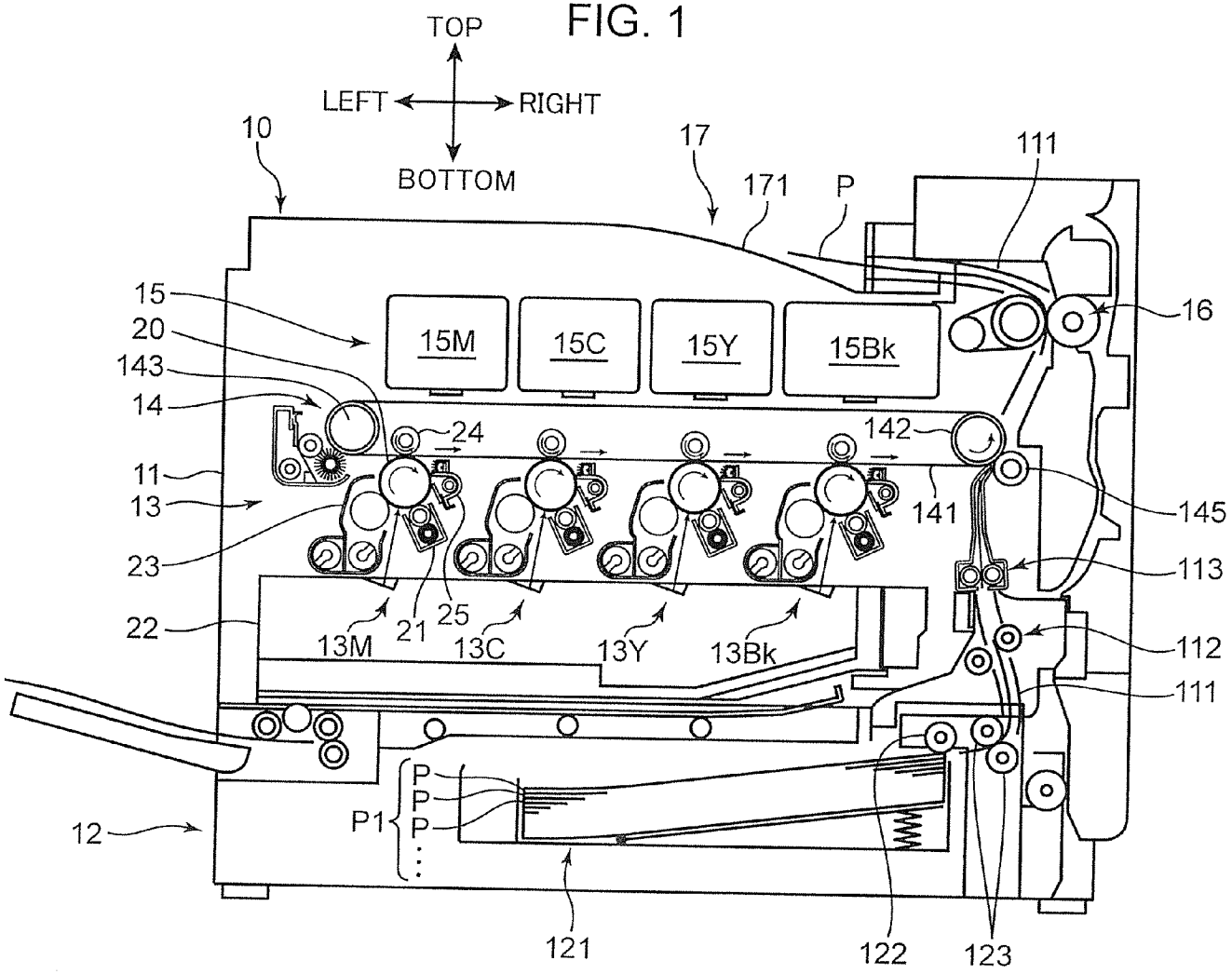
FIG. 1 is a sectional view showing an internal structure of an image forming apparatus according to an embodiment of the present disclosure.

FIG. 1 is a sectional view showing an internal structure of the image forming apparatus 10. The image forming apparatus 10 includes an apparatus body 11 in the form of a box-shaped housing. The apparatus body 11 includes therein a sheet feeding section 12 for feeding a sheet P, an image forming section 13 for forming a toner image to be transferred onto the sheet P fed by the sheet feeding section 12, an intermediate transfer unit 14 to which the toner image is primarily transferred, a secondary transfer roller 145, a toner supply section 15 for supplying toner to the image forming section 13, and a fixing section 16 for fixing the toner image onto the sheet P, the toner image having been formed but unfixed on the sheet P. In addition, in an upper portion of the apparatus body 11, a sheet receiving section 17 is provided for receiving the sheet P subjected to the fixing process in the fixing section 16.

Further in the apparatus body 11, a sheet conveyance passage 111 extending in a vertical direction is formed on the right side of the image forming section 13. A pair of conveyance rollers 112 for conveying a sheet P is disposed at an appropriate position in the sheet conveyance passage 111. In addition, a pair of registration rollers 113 for performing skew correction and advancing a sheet P into a secondary transfer nip described later at a predetermined timing is disposed upstream of the nip in the sheet conveyance passage 111. The sheet conveyance passage 111 allows conveyance of a sheet P from the sheet supply section 12 to the sheet receiving section 17 through the image forming section 13 (secondary transfer nip) and the fixing section 16.

The sheet feeding section 12 includes a sheet feeding tray 121, a pick-up roller 122 and a pair of sheet feeding rollers 123. The sheet feeding tray 121 is detachably mounted at a lower position of the apparatus body 11 and stores a sheet stack P1 composed of laminated sheets P. The pick-up roller 122 picks up the sheets P stored in the sheet feeding tray 121 one by one from a sheet P placed on the top of the sheet stack P1. The pair of sheet feeding rollers 123 advances the sheet P picked up by the pick-up roller 122 into the sheet conveyance passage 111.

The image forming section 13 includes a plurality of image forming units which respectively form toner images of different colors that are to be transferred onto a sheet P. In the present embodiment, the image forming units include a magenta unit 13M which uses developer containing magenta (M) toner, a cyan unit 13C which uses developer containing cyan (C) toner, a yellow unit 13Y which uses developer containing yellow (Y) toner, and a black unit 13Bk which uses developer containing black (Bk) toner that are successively arranged from the upstream side to the downstream side (from the left side to the right side of the sheet of FIG. 1) in a rotational direction of an intermediate transfer belt 141 described later. Each of the units 13M, 13C, 13Y and 13Bk includes a photoconductive drum 20, a charging device 21 disposed near the photoconductive drum 20, a developing device 23, and a cleaning device 25. Further, an exposure device 22 commonly used for the image forming units 13M, 13C, 13Y and 13Bk is disposed below these units.

The photoconductive drum 20 is driven to rotate about an axis thereof, and has a circumferential surface for allowing an electrostatic latent image and a toner image to be formed thereon. An organic photoconductor (OPC) may be used as the photoconductive drum 20. The photoconductive drums 20 are disposed at positions respectively corresponding to the image forming units provided for the respective colors. The charging device 21 charges the surface of the photoconductive drum 20 uniformly. The charging device 21 includes a charging roller, and a charging cleaning brush for removing toner adhered to the charging roller. The exposure device 22 includes various optical system devices such as a light source, a polygon mirror, a reflection mirror and a deflection mirror, and irradiates the circumferential surface of the uniformly charged photoconductive drum 20 with beams of light having been modulated in accordance with image data to form an electrostatic latent image thereon. The cleaning device 25 cleans the circumferential surface of the photoconductive drum 20 after a toner image is transferred therefrom.

The developing device 23 supplies toner to the circumferential surface of the photoconductive drum 20 to develop an electrostatic latent image formed on the photoconductive drum 20. The developing device 23 is designed to use two-component developer composed of toner and carrier. In addition, in the present embodiment, toner has the property to be charged to positive polarity.

The intermediate transfer unit 14 is disposed in a space defined between the image forming section 13 and the toner supply section 15. The intermediate transfer unit 14 includes the intermediate transfer belt 141, a driving roller 142, a driven roller 143, and primary transfer rollers 24.

The intermediate transfer belt 141 is a rotary member in the form of an endless belt, and is wound around the driving roller 142 and the driven roller 143 so that a circumferential surface of the intermediate transfer belt 143 comes into contact with the circumferential surface of each photoconductive drum 20. The intermediate transfer belt 141 is driven to circularly move in a specific direction, and has a surface for carrying toner images transferred from the photoconductive drums 20 thereon.

The driving roller 142 is disposed at a right end of the intermediate transfer unit 14 and supports the intermediate transfer belt 141 in a strained state thereon, the driving roller 142 driving the intermediate transfer belt 141 to circularly move. The driving roller 142 is made of a metallic material. The driven roller 143 is disposed at a left end of the intermediate transfer unit 14, and supports the intermediate transfer belt 141 in the strained state thereon, the driven roller 143 imparting a tension to the intermediate transfer belt 141.

Each of the primary transfer rollers 24 defines a primary transfer nip in cooperation with the corresponding photoconductive drum 20 with the intermediate transfer belt 141 being sandwiched therebetween, and primarily transfers a toner image formed on the photoconductive drum 20 onto the intermediate transfer belt 141. The primary transfer rollers 24 are disposed at positions respectively corresponding to the photoconductive drums 20 provided for the respective colors.

The secondary transfer roller 145 is disposed opposite to the driving roller 142 across the intermediate transfer belt 141. The secondary transfer roller 145 is pressed against the circumferential surface of the intermediate transfer belt 141, thereby defining the secondary transfer nip. A toner image primarily transferred on the intermediate transfer belt 141 is secondarily transferred onto a sheet P at the secondary transfer nip, the sheet P being supplied from the sheet supply section 12. The intermediate transfer unit 14 and the secondary transfer roller 145 of the present embodiment constitute a transfer section of the present disclosure. The transfer section transfers a toner image from each photoconductive drum 20 to a sheet P.

The toner supply section 15 stores toner to be used for image formation and, in the present embodiment, includes a toner container 15M for magenta, a toner container 15C for cyan, a toner container 15Y for yellow, and a toner container 15Bk for black. These toner containers 15M, 15C, 15Y, and 15Bk supply toners of respective colors, through an unillustrated toner conveyance section, to the corresponding image forming units 13M, 13C, 13Y, and 13Bk of the developing device 23 provided for the colors of magenta, cyan, yellow, and black, respectively.

A sheet P having been supplied to the fixing section 16 passes through a fixing nip at which the sheet P is heated and pressed. Consequently, a toner image transferred onto the sheet P at the secondary transfer nip is fixed on the sheet P.

The sheet receiving section 17 is in the form of a recess formed in a top portion of the apparatus body 11, the recess having a bottom that defines a sheet receiving tray 171 for receiving a discharged sheet P. A sheet P having been subjected to the fixing process is discharged to the sheet receiving tray 171 through the sheet conveyance passage 111 extending from an upper portion of the fixing section 16.

Figure 2:
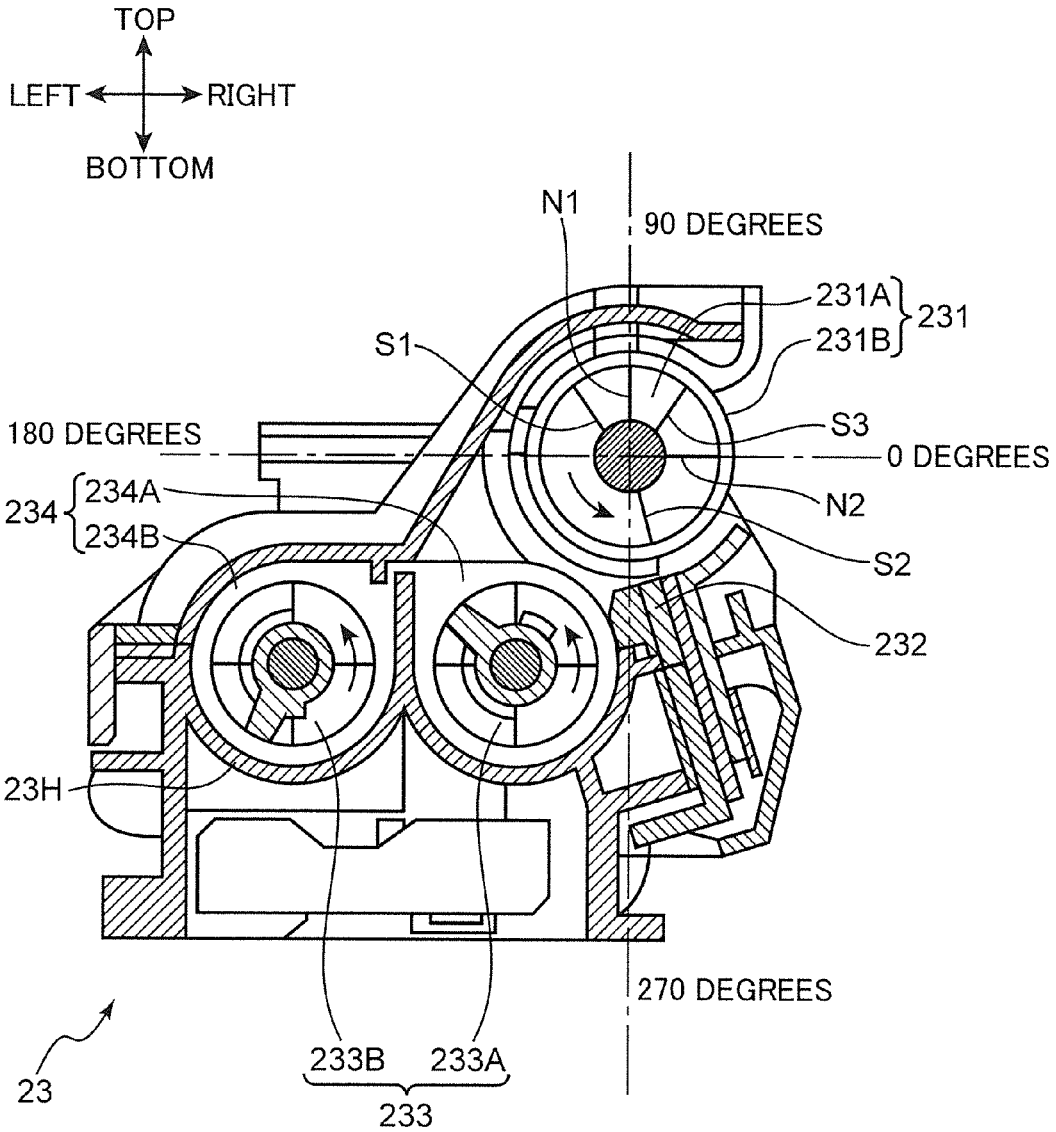
FIG. 2 is a schematic sectional view showing an internal structure of a developing device according to the embodiment of the present disclosure.

Now the developing device 23 according to the present embodiment will be further described in detail with reference to FIG. 2. FIG. 2 is a schematic sectional view showing an internal structure of the developing device 23 according to the present embodiment. In FIG. 2, respective rotational directions of rotary members of the developing device 23 are indicated by arrows.

The developing device 23 includes a housing 23H, a developing roller 231, a layer thickness regulating member 232, a stirring screw 233, and a developer conveyance section 234. The housing 23H supports the members of the developing device 23. The housing 23H contains developer including toner and magnetic carrier.

The developing roller 231 is supported on the housing 23H, while facing the corresponding photoconductive drum 20 having the surface for allowing an electrostatic latent image to be formed thereon at a predetermined developing position, to supply toner to the photoconductive drum 20. The developing roller 231 includes a stationary magnet 231A and a sleeve 231B (FIG. 2). In the present embodiment, the developing position includes a position at which the photoconductive drum 20 and the developing roller 231 are closest to each other. The stationary magnet 231A is in the form of a cylinder and secured to the housing 23H, the stationary magnet 231A including a plurality of magnetic poles arranged in a circumferential direction. The sleeve 231B rotates around the stationary magnet 231A in a predetermined rotational direction (see an arrow shown in FIG. 2) and has a circumferential surface for carrying developer including toner and magnetic carrier thereon. In the present embodiment, the sleeve 231B is in the form of an aluminum circular tube (made of an aluminum base material). In the circumferential portion of the sleeve 231B in the form of the circular tube, a plurality of grooves (knurling grooves) are formed at intervals in the circumferential direction.

A development bias is applied to the developing roller 231, the bias including an alternating current bias and a direct current bias that are superposed on each other. The developing roller 231 and the photoconductive drum 20 rotate in the same direction (also referred to as "with direction" or "trailing direction") at the developing position.

The layer thickness regulating member 232 includes a plate-like member made of a non-magnetic metal and is disposed opposite to the sleeve 231B of the developing roller 231. In another embodiment, a magnetic member may be secured to an upstream side surface of the layer thickness regulating member 232. The layer thickness regulating member 232 regulates the layer thickness of developer supplied to the developing roller 231 by a first screw 233A of the stirring screw 233. The layer thickness regulating member 232 is disposed below the developing roller 231.

The stirring screw 233 circulates two-component developer while stirring it to thereby charge toner. The stirring screw 233 includes the first screw 233A (developer stirring member) and a second screw 233B. The first screw 233A and the second screw 233B are rotatably supported on the housing 23H. Further, each of the first screw 233A and the second screw 233B includes a shaft and a helical blade formed around the shaft.

The developer conveyance section 234 is formed in the housing 23H and serves as a circulation passage for developer. The developer conveyance section 234 includes a first conveyance portion 234A in which the first screw 233A is disposed and a second conveyance portion 234B in which the second screw 233B is disposed (FIG. 2). The first conveyance portion 234A is divided from the second conveyance portion 234B by a plate-like partition member disposed therebetween. Axial opposite ends of the first conveyance portion 234A respectively communicate with axial opposite ends of the second conveyance portion 234B. Developer is circulated through the first conveyance portion 234A and the second conveyance portion 234B. The first screw 233A supplies developer to the developing roller 231. Further, toner supplied from the toner supply section 15 flows into the housing 23H through one axial end of the second conveyance portion 234B to be stirred with developer flowing in the housing 23H.

As shown in FIG. 1, the axis of the developing roller 231 lies below the axis of the photoconductive drum 20, and the axis of the first screw 233A lies below the axis of the developing roller 231 (FIG. 2).

With reference to FIG. 2, developer including toner and carrier and having been circulated by the stirring screw 233 is supplied to the developing roller 231 from the first stirring screw 233A. Thereafter, the layer thickness of the developer is regulated by the layer thickness regulating member 232 so that a portion of the toner is supplied to the photoconductive drum 20 at the developing position, and then the remaining developer is separated from the developing roller 231. Thereafter, the separated developer flows back into the first conveyance portion 234A enclosing the first screw 233A.

With reference to FIG. 2, in the present embodiment, the stationary magnet 231A of the developing roller 231 includes five magnetic poles arranged in the circumferential direction. An N2-pole lies near the developing position where the developing roller 231 faces the photoconductive drum 20. The N2-pole serves as a main magnetic pole for supplying toner to the photoconductive drum 20. A S3-pole lies downstream of the N2-pole in the rotational direction of the sleeve 231B. Further, an N1-pole lies downstream of the S3-pole in the rotational direction. Further, a S1-pole lies downstream of the N1-pole in the rotational direction. Further, a S2-pole lies downstream of the S1-pole in the rotational direction at a specific distance therefrom. The S1-pole and the S2-pole can alternatively be described as follows: the S1-pole lies downstream of the developing position in the rotational direction and has a specific polarity, the S1-pole constituting a first magnetic pole of the present disclosure; and the S2-pole lies downstream of the S1-pole in the rotational direction, and has the same polarity as the S1-pole, the S2-pole constituting a second magnetic pole of the present disclosure. The S2-pole faces the layer thickness regulating member 232. The S2-pole functions as a draw-up magnetic pole producing a magnetic field that allows the sleeve 231B to receive developer supplied by the first screw 233A. Further, the S2-pole also functions as a regulating magnetic pole producing a magnetic field that regulates the layer thickness of the developer supplied to the developing roller 231 in cooperation with the layer thickness regulating member 232. The S1-pole lies above the S2-pole. Further, the S1-pole lies above the axis of the developing roller 231, and the S2-pole lies below the axis of the developing roller 231.

Figure 3A:
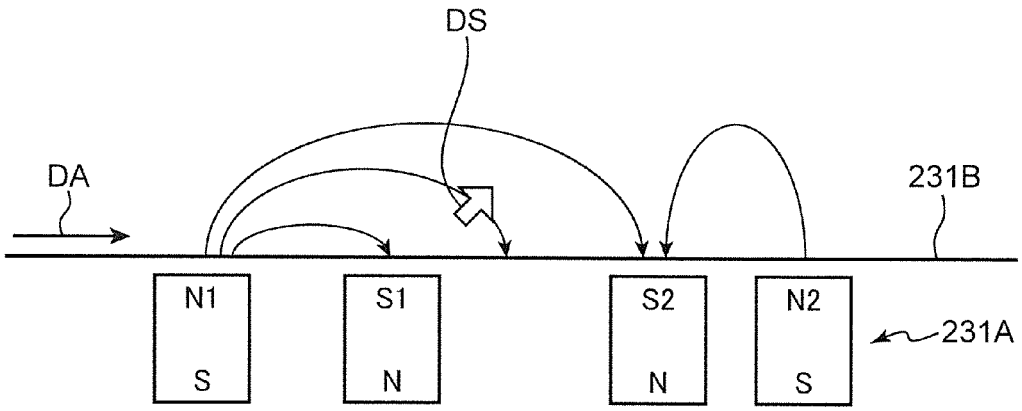
FIG. 3A is a schematic view illustrating magnetic fields produced by a stationary magnet of a developing roller according to the embodiment of the present disclosure.
Figure 3B:
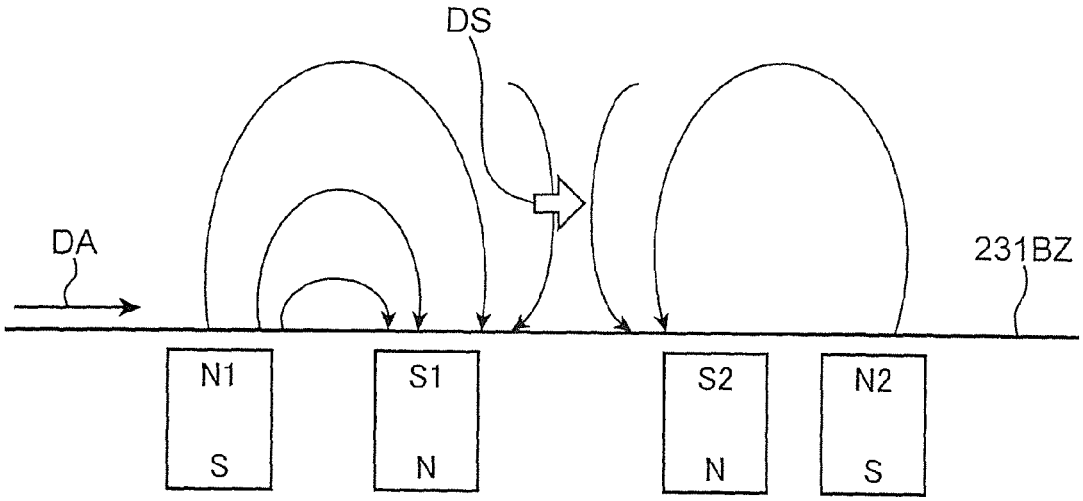
FIG. 3B (PRIOR ART)
FIG. 3B is a schematic view illustrating magnetic fields produced by a stationary magnet of another developing roller which is compared with the developing roller of the embodiment of the present disclosure.

FIG. 3A is a schematic view illustrating magnetic fields produced by the stationary magnet 231A of the developing roller 231 according to the present embodiment. FIG. 3B is a schematic view illustrating magnetic fields produced by a stationary magnet of another developing roller which is compared with the developing roller 231 of the present embodiment. In FIGS. 3A and 3B, the surface of each of the sleeve 231B and a sleeve 231BZ in the form of a cylinder is schematically represented by a straight line.

Conventionally, there is known a two-component developing method that uses repelling magnetic fields produced by like poles to separate developer from the developing roller. FIG. 3B illustrates such repelling magnetic fields. On the surface of the sleeve 231BZ, an N1-pole, a S1-pole, a S2-pole, and an N2-pole are successively arranged in the rotational direction (in the direction of the arrow DA). Magnetic pieces respectively including these magnetic poles, i.e. the N1-pole, the S1-pole, the S2-pole, and the N2-pole, at their respective one ends have the opposite poles, i.e. a S-pole, an N-pole, an N-pole, and a S-pole at their respective other ends. In the configuration of FIG. 3B, magnetic force lines of the S1-pole repel those of the S2-pole. Therefore, when horizontal magnetic force components, which are tangential to the surface of the sleeve 231BZ, are measured, there are found that the magnetic field direction is reversed at substantially the middle between the S1-pole and the S2-pole having the same polarity. In order that the direction of the horizontal magnetic force component is reversed at substantially the middle between the adjacent like poles in this way, the magnetic forces of the two like poles need to be substantially equal. This makes it difficult for the S1-pole and the S2-pole to include a function other than the separating function, and consequently, the design of magnetic poles of the developing roller is restricted.

In order to solve the above-described problem, the present embodiment has a characteristic magnetic pole arrangement in the stationary magnet 231A of the developing roller 231. It should be noted that in the description hereinafter, a magnetic force of a specific magnetic pole of the stationary magnet 231A refers to the density of magnetic flux (magnetic flux density) at the specific magnetic pole lying in the magnetic fields on the surface of the sleeve 231B produced by all the magnetic poles of the stationary magnet 231A. In particular, in the present embodiment, the S2-pole functions as a draw-up magnetic pole producing a magnetic field that allows the sleeve 231B to receive developer, and also as a regulating magnetic pole producing a magnetic field that regulates the layer thickness of the developer in cooperation with the layer thickness regulating member 232 as described above. Therefore, the S1-pole and the S2-pole need to have different magnetic forces. In the present embodiment, even when the two magnetic poles (i.e. the S1-pole and the S2-pole) serving as poles for separation need to have different magnetic forces, developer can be reliably separated from the developing roller 231.

The disclosures of the present disclosure have found that the separation of developer from the developing roller 231 is reliably performed when the horizontal magnetic force component is flat over a specific distance between poles having the same polarity (a region between respective maximum vertical magnetic force components of the two like poles). They also have found that the separation of developer is more reliable when the flat area is closer to the S2-pole than to the S1-pole.

Such developer separation is based on a force of the magnet to attract magnetic material (carrier), i.e. a magnetic attracting force. The magnetic attracting force is strong when the magnetic forces of the magnetic poles of the stationary magnet 231A are strong or when the magnetic force varies greatly in the circumferential direction. Therefore, when the vertical magnetic force component and the horizontal magnetic force component are "zero" around the middle between the S1-pole and the S2-pole, no magnetic attracting force occurs, so that developer having been separated at the S1-pole is unlikely to be adhered again to the developing roller 231 around the middle between the S1-pole and the S2-pole. However, when these two poles for separation have different magnetic forces, the vertical magnetic force component and the horizontal magnetic force component are unlikely to be "zero" in the region between the S1-pole and the S2-pole. Consequently, a magnetic attracting force occurs in the inter-pole region, so that developer is likely to be adhered again to the developing roller 231.

It should be noted that a failure in separating developer from the developing roller 231 is likely to be majorly due to a magnetic attracting force of the horizontal component. The reason is that developer is likely to be separated in the circumferential direction owing to rotation of the sleeve 231B of the developing roller 231, and when there is a magnetic attracting force of the horizontal component, the developer separated from the sleeve 231B is likely to be adhered again to the developing roller 231 owing to the attracting force.

With reference to FIG. 3A, in the stationary magnet 231A of the developing roller 231 according to the present embodiment, magnetic lines extend from the N1-pole to the S1-pole and to the S2-pole. Therefore, no repelling magnetic fields such as those shown in FIG. 3B exist between the S1-pole and the S2-pole. In such magnetic field, the flat area where the horizontal magnetic force component is flat is provided between the S1-pole and the S2-pole. This allows the magnetic attracting force of the horizontal component to suddenly drop in the flat area, which enhances the separation of developer.

Figure 4:
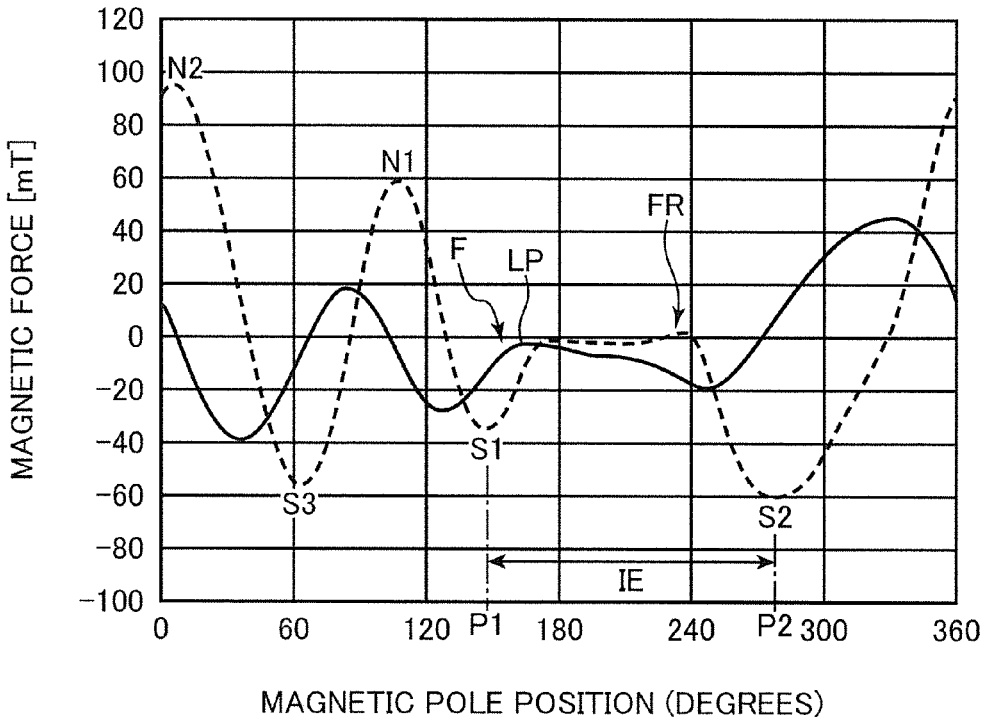
FIG. 4 is a graph showing a magnetic force distribution on a developing roller of an example of the present disclosure.

FIG. 4 is a graph showing an example of a magnetic force distribution of the stationary magnet 231A of the developing roller 231 according to the present embodiment. It should be noted that in the graphs including FIG. 4 described hereinafter each showing a magnetic force distribution, the horizontal axis represents magnetic pole positions (degrees), and the vertical axis represents magnetic forces (mT). The magnetic pole positions are plotted on the horizontal axis based on an angular scale shown in FIG. 2 that has marks at 0, 90, 180 and 270 degrees. In the vertical axis, the magnetic forces are plotted on the positive side when having the North polarity and on the negative side when having the South polarity. Further, in each graph, the horizontal magnetic force component and the vertical magnetic force component of the stationary magnet 231A are indicated by a solid line and a dashed line, respectively.

In order to improve the separation performance of developer based on the above-described mechanism, the stationary magnet 231A satisfies the following three conditions.

As a first condition, in an entire inter-pole region IE (FIG. 4) between a maximum vertical component position P1 of the magnetic force of the S1-pole and a maximum vertical component position P2 of the magnetic force of the S2-pole, the stationary magnet 231A produces a magnetic force including a horizontal component which is not inverted, i.e. keeps the polarity of the South pole, and has a value greater than zero (mT). In FIG. 4, the polarity of the South poles is indicated as negative, and therefore, the horizontal component is smaller than zero in the inter-pole region IE. In other words, in the entire inter-pole region IE, the absolute value of the horizontal magnetic force component is greater than zero, which means that the plotted line indicating the distribution of the horizontal component values does not cross the straight line on the magnetic force of zero (mT) (the horizontal component is not inverted, i.e. the polarity of the horizontal component does not change). This is the first condition.

As a second condition, the inter-pole region IE includes a flat area F where a horizontal magnetic force component having a minimum absolute value, i.e. a minimum magnetic force LP, exits, and the horizontal magnetic force component changes within a range of 0.5 (mT) or less, the flat area F extending over a range of 10 degrees or more in a rotational angle of the sleeve 231B.

As a third condition, when the maximum vertical magnetic force component of the S1-pole is A (mT), the half width of the vertical magnetic force component of the S1-pole is θ (degrees), the maximum vertical magnetic force component of the S2-pole is B (mT), and the half width of the vertical magnetic force component of the S2-pole is φ (degrees), the following relationship is satisfied:

$$2 \leq (B \times \varphi)/(A \times \theta) \leq 5 \quad \text{(Formula 1)}$$

The half width θ (φ) refers to the angular width given by the difference between the two extreme values of the magnetic force of the S1-pole (the S2-pole) at which the magnetic force is equal to half of its maximum value. Specific values of A, B, θ, and φ are shown in Table 1 described below.

Satisfaction of the first condition prevents formation of repelling magnetic fields between the S1-pole and the S2-pole. In addition, satisfaction of the second condition produces the flat area F capable of separating developer therefrom. Further, satisfaction of the third condition allows formation of the flat area F at a position closer to the S1-pole than to the S2-pole. Consequently, the magnetic attracting force acting on developer having passed over the S1-pole suddenly drops, which allows a reliable separation of the developer from the sleeve 231B. Thus, the developer separation by the adjacent two like poles can be reliably achieved. Further, as long as the S1-pole and the S2-pole satisfy the above-mentioned conditions, these two poles can be made to have different magnetic forces. In particular, it is possible to allow the S2-pole to have a different magnetic force from that of the S1-pole to function as a draw-up magnetic pole and as a regulating magnetic pole. Therefore, it is possible to enhance flexibility in design of the magnetic poles of the developing roller 231. Moreover, it is possible to suppress density irregularities and density deterioration due to a developer separation failure.

With regard to the second condition, it is more desirable that the flat area F extends over a range of 14 degrees or more in the rotational angle of the sleeve 231B. In this case, the magnetic attracting force acting on developer having passed over the S1-pole drops more suddenly, which allows a more reliable separation of the developer from the sleeve 231B.

Further, in the present embodiment, as shown in FIG. 2, the layer thickness regulating member 232 lies below the developing roller 231, and the S1-pole lies above the S2-pole. This allows a reliable separation of developer from the developing roller 231 and a fall of the developer having separated from the S1-pole in the housing 23H by gravity.

Further, the S1-pole lies above the axis of the developing roller 231 and the S2-pole lies below the axis of the developing roller 231. This allows a more reliable fall of the developer having separated from the S1-pole in the housing 23H by gravity.

Examples

Now, the present disclosure will be further described with reference to examples. Experiments were performed under the following experimental conditions.

Experimental Conditions (a) Photoconductive drum 20: an OPC photoconductor having a diameter φ of 30 mm, a surface electrical potential Vo of 450V in a blank portion and a surface potential VL of 100V in an image portion, and a circumferential speed of 300 mm/sec (b) Print speed: 32 sheets/min (c) Developer conveyance amount on the developing roller 231 (after the layer thickness regulation): 250 g/m2 d) Carrier: a volume average particle diameter of 35 μm; a magnetic force of 80 emu/g; and a resin-coated carrier (e) Toner: a volume average particle diameter of 6.81 km; a toner density of 7%; and a positive charge property The developing roller 231 satisfying the following conditions was used in the experiments:

(f) Developing roller 231: a diameter φ of 16 mm (g) The circumferential ratio of the developing roller 231 to the photoconductive drum 20: 1.8 (in the trailing direction)

(h) The gap between the developing roller 231 and the photoconductive drum 20: 350 μm (i) Developing bias: a direct current bias of 350V; an alternating current bias of Vpp1.2 kV; a frequency f of 3.7 kHz; a duty of 50%, a rectangular wave (it should be noted that the layer thickness regulating member 232 has the same electrical potential as the developing roller 231)

(j) The surface conditions of the sleeve 231B: knurling V-shaped grooves (having a depth of 80 μm and a width of 0.2 mm, and 120 in number)

Table 1 shows magnetic pole conditions of a stationary magnet of a developing roller used in each experiment. Eighteen developing rollers 231 with Experiment Numbers from 1 to 18 were used in the experiments. Experiment Nos. 1, 2, 17, and 18 correspond to comparative examples, and Experiment Nos. 3 to 16 correspond to examples of the present disclosure. The magnetic force measurement of the developing rollers used in the experiments was performed using a GAUSS METER Model GX-100 manufactured by Nihon Denji Sokki co., ltd. Table 1 shows a vertical magnetic force component (maximum magnetic force) of each of the N1-pole, the S1-pole, the S2-pole, and the N2-pole (under the column "VERTICAL MAGNETIC FORCE (mT)"). Here, the maximum magnetic forces of the North poles are recorded as positive values and the maximum magnetic forces of the South poles are recorded as negative values. In addition, the position (degree) of the maximum vertical magnetic force of each of the N1-pole, the S1-pole, the S2-pole, and the N2-pole is shown (under the column "VERTICAL MAGNETIC FORCE (DEGREES)"). Further, the above-described respective half widths of the S1-pole and the S2-pole are shown under the columns "θ" and "φ", respectively. These values each refers to an angular width. Further, in Table 1, the angular position of one of two angular positions at which a value is equal to half of the maximum magnetic force of the S1-pole is shown under the column "S1 HALF", the one position being closer to the S2 pole than the other. Further, values shown under the column "AREA RATIO" in Table 1 are those obtained by applying Formula 1: $(B\times\varphi)/(A\times\theta)$ to each of the developing rollers 231.

TABLE 1

| | VERTICAL MAGNETIC FORCE (mT) | | | | VERTICAL MAGNETIC FORCE (DEGREES) | | | | | | | |
|---|---|---|---|---|---|---|---|---|---|---|---|---|
| No | N1 | S1 | S2 | N2 | N1 | S1 | S1 HALF | θ | S2 | φ | N2 | AREA RATIO |
| 1 | 62 | −54 | −62 | 102 | 111 | 151 | 165 | 27 | 282 | 52 | 7 | 2.2 |
| 2 | 96 | −40 | −44 | 32 | 94 | 137 | 146 | 19 | 270 | 40 | 346 | 2.3 |
| 3 | 59 | −34 | −60 | 96 | 107 | 147 | 161 | 27 | 277 | 57 | 6 | 3.7 |
| 4 | 53 | −33 | −62 | 93 | 112 | 152 | 166 | 27 | 283 | 54 | 8 | 3.7 |
| 5 | 58 | −32 | −60 | 94 | 113 | 152 | 164 | 25 | 285 | 50 | 13 | 3.7 |
| 6 | 35 | −25 | −47 | 98 | 111 | 137 | 150 | 25 | 278 | 63 | 359 | 4.7 |
| 7 | 42 | −26 | −64 | 102 | 105 | 144 | 157 | 27 | 281 | 55 | 6 | 5.0 |
| 8 | 61 | −32 | −56 | 97 | 107 | 147 | 161 | 29 | 279 | 66 | 7 | 4.0 |
| 9 | 51 | −31 | −64 | 101 | 111 | 151 | 165 | 28 | 282 | 56 | 6 | 4.1 |
| 10 | 58 | −29 | −59 | 95 | 115 | 150 | 163 | 26 | 284 | 55 | 12 | 4.4 |
| 11 | 83 | −35 | −44 | 76 | 119 | 170 | 181 | 23 | 282 | 41 | 358 | 2.3 |
| 12 | 96 | −25 | −45 | 32 | 93 | 129 | 150 | 43 | 268 | 81 | 346 | 3.4 |
| 13 | 42 | −26 | −64 | 108 | 101 | 141 | 156 | 30 | 285 | 58 | 6 | 4.8 |
| 14 | 96 | −28 | −43 | 32 | 94 | 134 | 143 | 18 | 269 | 42 | 346 | 3.6 |
| 15 | 61 | −30 | −60 | 97 | 111 | 151 | 166 | 29 | 282 | 57 | 10 | 3.9 |
| 16 | 96 | −32 | −43 | 32 | 94 | 136 | 145 | 18 | 269 | 40 | 346 | 3.0 |
| 17 | 57 | −25 | −61 | 100 | 109 | 148 | 162 | 27 | 285 | 59 | 8 | 5.3 |
| 18 | 74 | −44 | −46 | 46 | 41 | 105 | 123 | 36 | 234 | 34 | 288 | 1.0 |

Figure 5:
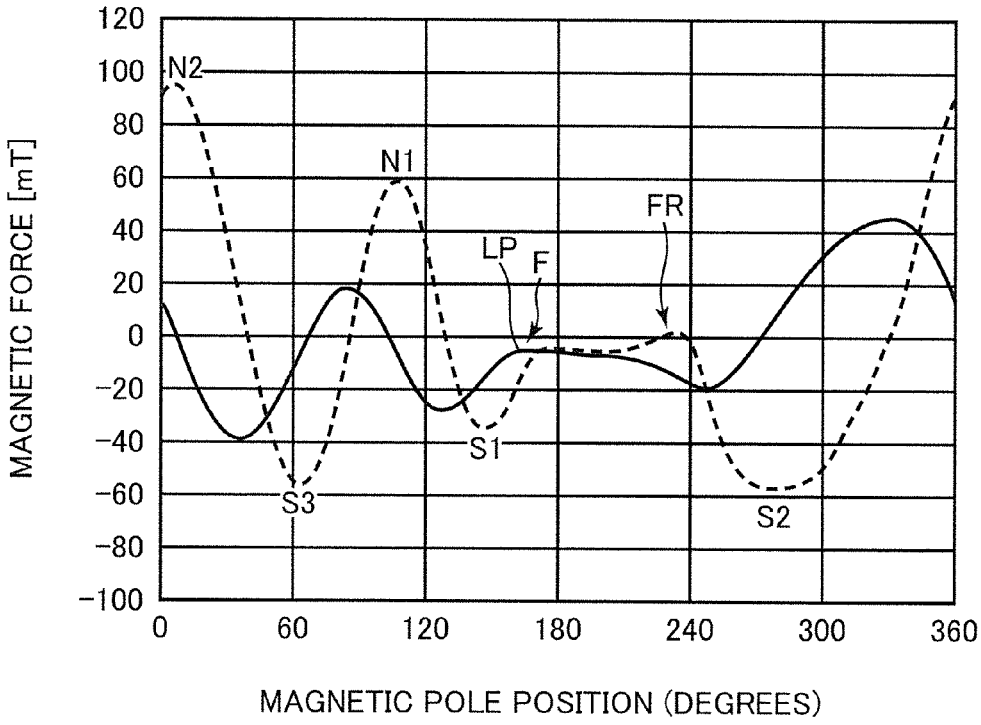
FIG. 5 is a graph showing a magnetic force distribution on a developing roller of another example of the present disclosure.
Figure 6:
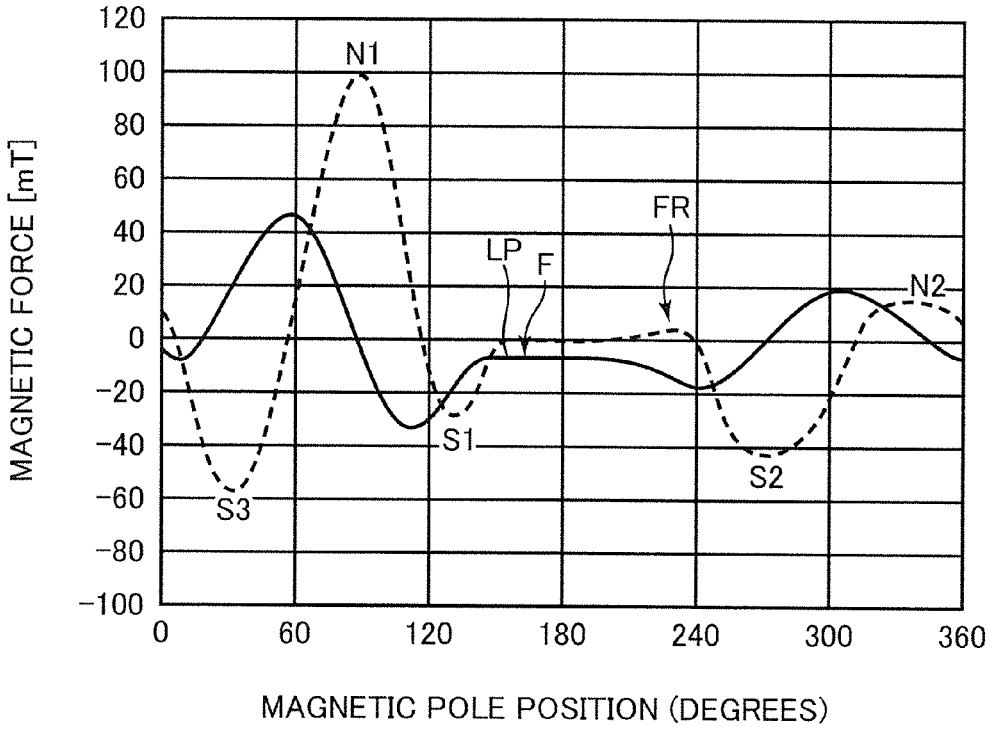
FIG. 6 is a graph showing a magnetic force distribution on a developing roller of another example of the present disclosure.
Figure 7:
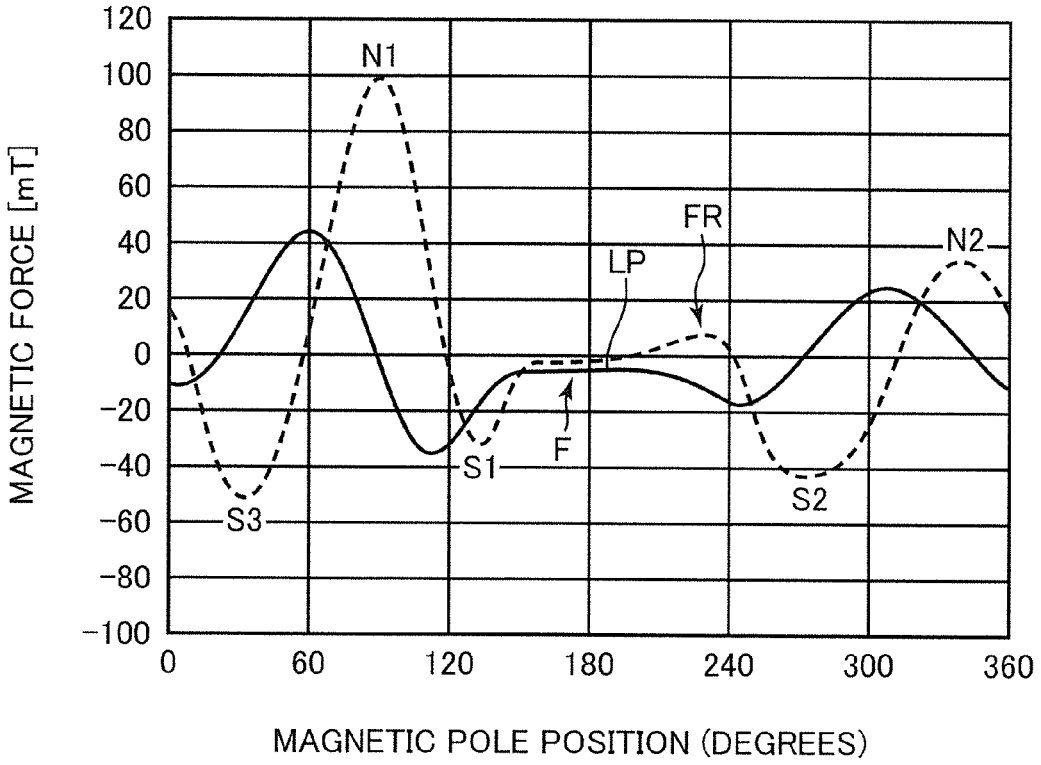
FIG. 7 is a graph showing a magnetic force distribution on a developing roller of another example of the present disclosure.
Figure 8:
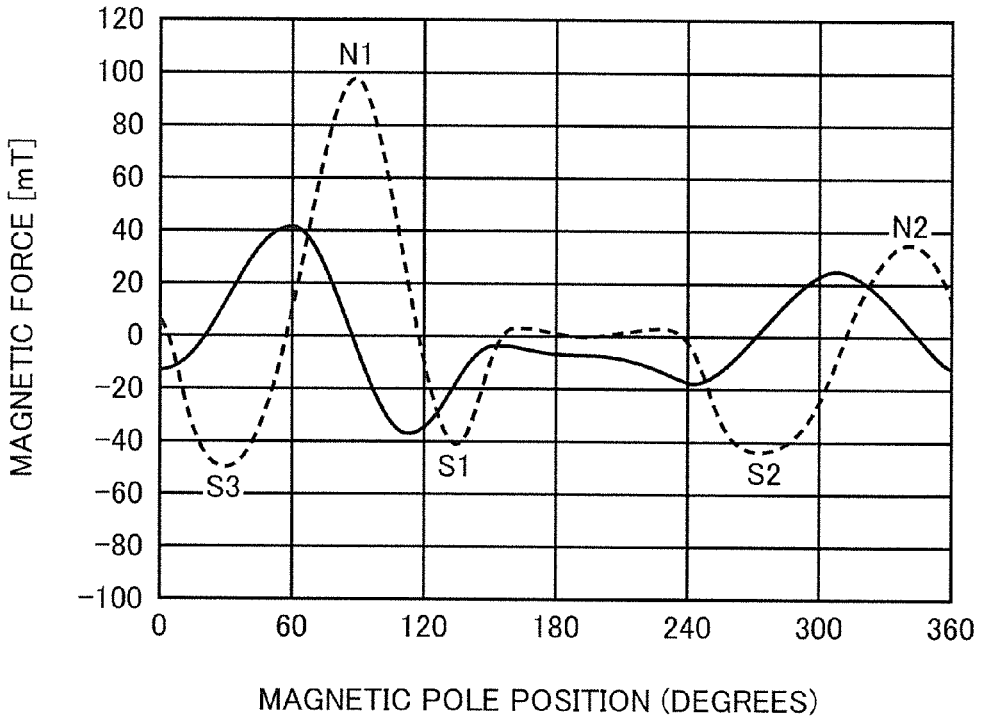
FIG. 8 is a graph showing a magnetic force distribution on a developing roller of a comparative example compared with examples of the present disclosure.
Figure 9:
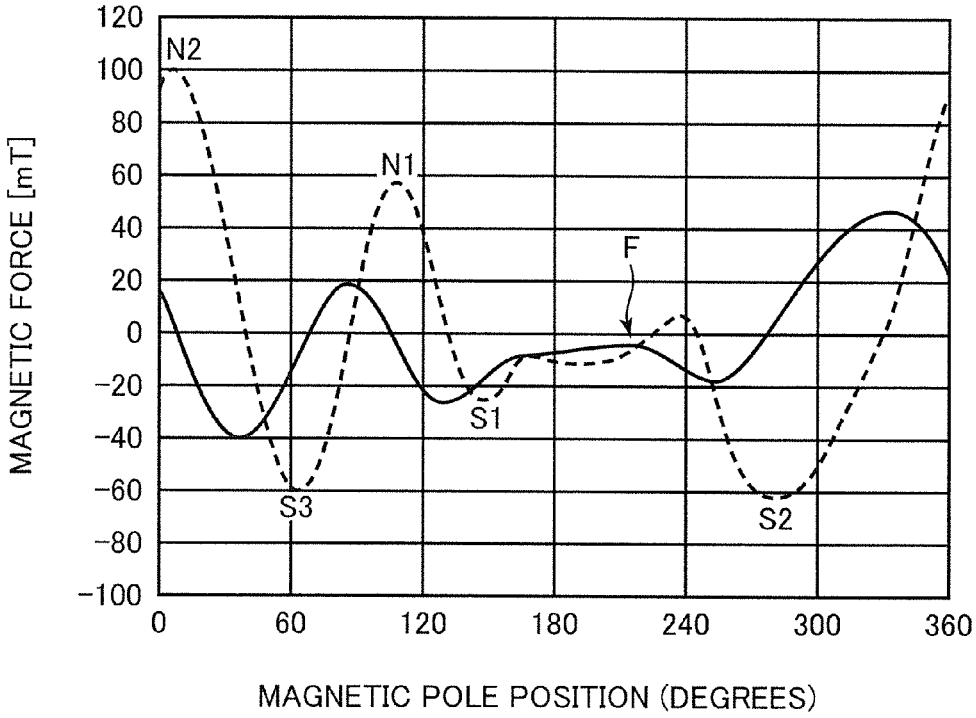
FIG. 9 is a graph showing a magnetic force distribution on a developing roller of another comparative example compared with the examples of the present disclosure.
Figure 10:
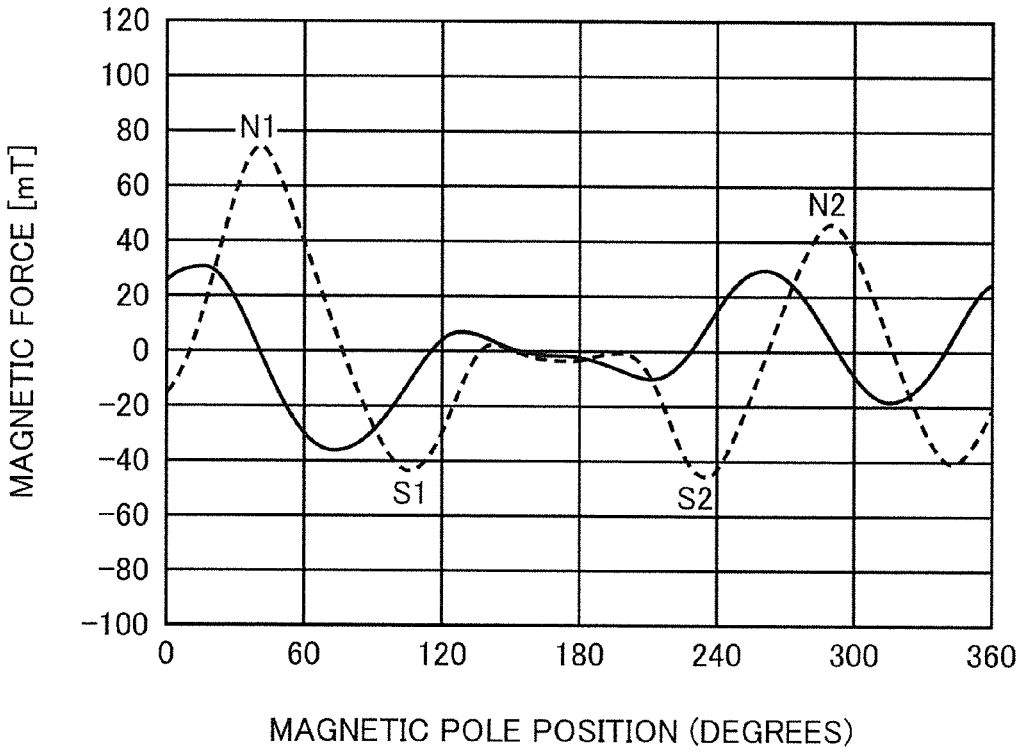
FIG. 10 is a graph showing a magnetic force distribution on a developing roller of another comparative example compared with the examples of the present disclosure.

FIG. 4 is a graph showing a magnetic force distribution on the developing roller of Experiment No. 3 in Table 1. FIG. 5 is a graph showing a magnetic force distribution on the developing roller of Experiment No. 8 in Table 1. FIG. 6 is a graph showing a magnetic force distribution on the developing roller of Experiment No. 14 in Table 1. FIG. 7 is a graph showing a magnetic force distribution on the developing roller of Experiment No. 16 in Table 1. FIG. 8 is a graph showing a magnetic force distribution on the developing roller of Experiment No. 2 in Table 1. FIG. 9 is a graph showing a magnetic force distribution on the developing roller of Experiment No. 17 in Table 1. FIG. 10 is a graph showing a magnetic force distribution on the developing roller of Experiment No. 18 in Table 1.

Further, Table 2 shows conditions of a flat area F (see FIG. 4) of each of the developing rollers 231 of Experiment Nos. 1 to 18 (under the column header "HORIZONTAL MAGNETIC FORCE FLAT PART (0.5 mT RANGE"). As described above, the flat area F refers to an area in the inter-pole region IE (FIG. 4) where a horizontal magnetic force component having a minimum absolute value, i.e. a minimum magnetic force LP, exits, and the horizontal magnetic force component changes within a range of 0.5 (mT) or less. Therefore, the difference between the maximum magnetic force and the minimum magnetic force in the flat area F is 0.5 (mT). In Table 2, values under the column "FLAT PART CENTRAL MAGNETIC FORCE" each refers to a value of the horizontal magnetic force component at a position where its absolute value is greater than the minimum magnetic force LP by 0.25 (mT). Further, values under the column "MINIMUM MAGNETIC FORCE" each refer to a value of the minimum magnetic force LP. These horizontal magnetic force components are recorded in FIG. 2 as positive values when the developing roller 232 rotates clockwise (rightward) and as negative values when the developing roller 232 rotates counterclockwise (leftward). Further, values under the column "MINIMUM VALUE POSITION (DEGREES)" each refers to an angular position of the minimum magnetic force LP. Values under the column "FLAT PART WIDTH" each refers to a width (angular width) over which the flat area F extends. Further, values under the column "FLAT PART CENTRAL MAGNETIC FORCE×WIDTH" each refer to a value obtained by multiplying the value of "FLAT PART CENTRAL MAGNETIC FORCE" and the value of "FLAT PART WIDTH".

TABLE 2

| | HORIZONTAL MAGNETIC FORCE FLAT PART (0.5 mT RANGE) | | | | FLAT PART | | |
|---|---|---|---|---|---|---|---|
| | | MINIMUM | | | CENTRAL | SEPARATION PERFORMANCE | |
| No | FLAT PART CENTRAL MAGNETIC FORCE (mT) | MAGNETIC FORCE (mT) | MINIMUM VALUE POSITION (DEGREES) | FLAT PART WIDTH (DEGREES) | MAGNETIC FORCE × WIDTH | IMAGE IRREGULARITIES | DEVELOPER REMAINDER IN GROOVES |
| 1 | 5.9 | 6.1 | 170 | 7.3 | 41 | X | X |
| 2 | −3.5 | −3.3 | 154 | 9.1 | −34 | X | X |
| 3 | −2.2 | −1.9 | 166 | 10.1 | −24 | Δ | X |
| 4 | −2.4 | −2.1 | 173 | 11.0 | −29 | Δ | X |
| 5 | −1.5 | −1.2 | 171 | 11.4 | −19 | Δ | X |
| 6 | −1.2 | −1.0 | 156 | 11.7 | −17 | Δ | X |
| 7 | −2.1 | −1.8 | 163 | 12.9 | −30 | Δ | X |
| 8 | −4.3 | −4.0 | 168 | 14.0 | −63 | ○ | ○ |
| 9 | −4.0 | −3.7 | 173 | 14.6 | −61 | ○ | ○ |
| 10 | −5.6 | −5.3 | 170 | 15.6 | −90 | ○ | ○ |
| 11 | −3.9 | −3.6 | 191 | 16.4 | −68 | ○ | ○ |
| 12 | −6.1 | −5.9 | 161 | 17.7 | −113 | ○ | ○ |
| 13 | −2.2 | −1.9 | 164 | 19.9 | −48 | ○ | ○ |
| 14 | −7.1 | −6.8 | 155 | 23.4 | −171 | ○ | ○ |
| 15 | −5.1 | −4.8 | 174 | 31.4 | −166 | ○ | ○ |
| 16 | −5.9 | −5.6 | 185 | 48.4 | −298 | ○ | ○ |
| 17 | −4.4 | −4.1 | 211 | 18.0 | −83 | X | X |
| 18 | 6.6 | 6.8 | 129 | 8.0 | 51 | X | X |

Further, Table 2 shows an evaluation result of the separation performance in each experiment. "IMAGE IRREGULARITIES" refers to a state in which density irregularities corresponding to the pitch and shape of the first screw 233A of the stirring screw 233 appear on an image formed by the image forming apparatus 10. When the developer separability (separability) from the developing roller 231 is bad, developer having passed over the developing position adheres again to the S2-pole. At this time, developer supplied from the first screw 233A and the re-adhering developer have different toner densities, which therefore causes occurrence of density irregularities corresponding to the shape of the first screw 233A on an image. Occurrence of irregularities is remarkably observed when there is a large amount of developer around the first screw 233A. The evaluation of "IMAGE IRREGULARITIES" was performed on the following scale.

○: No problem appears on an image.

Δ: Slight density irregularities corresponding to the first screw 233A appear on an image but cause no problem in practical use.

x: Density irregularities corresponding to the first screw 233A appear on an image.

Figure 11:
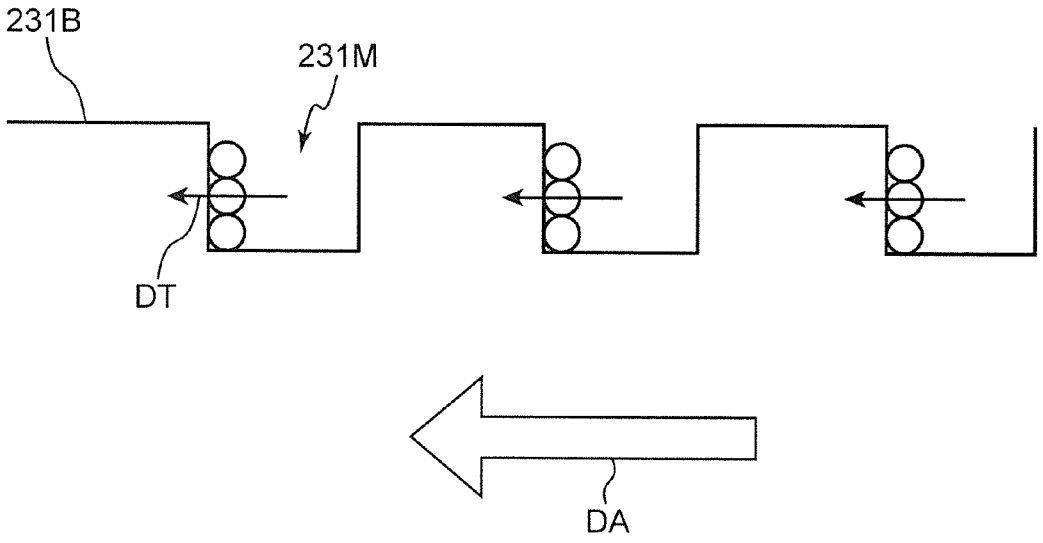
FIG. 11 is a schematic sectional view showing grooves formed in an outer portion of a developing roller.

"DEVELOPER REMAINDER IN GROOVES" refers to a state in which developer remains in the grooves formed in the sleeve 231B of the developing roller 231. FIG. 11 is a schematic view showing the grooves (231M) formed in the outer portion of the developing roller 231. If there is a magnetic field with magnetic forces having a great horizontal component (the arrow DT in FIG. 11) over which the groove 231M moves from the S1-pole (FIG. 2) to the S2-pole owing to rotation of the sleeve 231B (the arrow DA in FIG. 11), developer is pushed strongly against a wall of the groove 231M. This results in insufficient separation of developer from the developing roller 231, and consequently, portion of the developer remains in the grooves 231M. In this case, image density is liable to decrease due to a decrease in the developer conveyance performance of the developing roller 231 and a decrease in the toner density. Table 2 shows evaluation results of remaining of developer in the grooves 231M, the evaluation being performed after the above-mentioned evaluations of image irregularities. It was evaluated as "○" when developer hardly remained in the grooves 231M, and as "x" when a large amount of developer remained in the grooves 231M.

In order to prevent inversion of the horizontal magnetic force component, i.e. in order to prevent the line of horizontal component values from crossing the straight line on the magnetic force of zero, in the inter-pole region IE (FIG. 4) extending between the S1-pole and the S2-pole, the S1-pole and the S2-pole need to have magnetic forces that differ from each other by a predetermined value. It was found that when the value of "AREA RATIO" (=(B×φ)/(A×θ)) shown in Table 1 was 2 or more, the horizontal magnetic force component was not inverted. In Experiment Nos. 1 to 17 shown in Table 1, the area ratio was set to 2 or more. It should be noted that the area ratio of 3 or more yielded a more desirable result. However, in Experiment Nos. 1 and 2, image irregularities occurred. This was because "the width of the flat area F (FLAT PART WIDTH)" was less than 10 degrees, which resulted in insufficient separation of developer from the developing roller 231.

Further, in Experiment 18, the area ratio was 1, which resulted in inversion of the horizontal magnetic force component. Usually, a magnetic brush of developer formed on the sleeve 231B of the developing roller 231 extends along a magnetic line of force. In Experiment Nos. 3 to 17, a magnetic brush separated from the sleeve 231B in an oblique state as shown by the arrow DS in FIG. 3A. On the other hand, when there was inversion of magnetic fields as in Experiment No. 18, a magnetic brush separated from the sleeve 231B along a tangent line to the developing roller 231 in a curved state as shown by the arrow DS in FIG. 3B. In other words, developer was more likely to leave the sleeve 231B along a normal line of the developing roller 231 in Experiment Nos. 3 to 17 than in Experiment No. 18. In Experiment No. 18, developer left along tangent lines, which therefore resulted in insufficient dispersion of the separated developer on the first screw 233A. Consequently, when the amount of developer circulating around the first screw 233A was small, image irregularities corresponding to the pitch of the first screw 233A were obviously seen. On the other hand, in Experiment Nos. 3 to 17, developer left the developing roller 231 along normal lines, which resulted in dispersion of the separated developer over a wide range of the first screw 233A in the circumferential direction. As a result, the separated developer and developer having been circulating in the developer conveyance section 234 were easily mixed and stirred. Consequently, the occurrence of image irregularities was prevented.

On the other hand, in Experiment 17, "AREA RATIO" (=(B×φ)/(A×θ)) exceeded 5. In this case, the S1-pole and the S2-pole had magnetic forces that differed from each other greatly, and therefore, the flat area IE (FIG. 4) was formed at a position closer to the S2-pole than to the S1-pole (see FIG. 9). Therefore, even when developer separated from the developing roller 231 at the flat area F, the separated developer was attracted again by the magnetic force of the S2-pole lying on the near downstream side and was adhered again to the S2-pole. As a result, irregularities occurred as recorded in Table 2.

As described above, Experiment Nos. 3 to 16 yielded results that "IMAGE IRREGULARITIES" that would cause practical problems did not occur. In the developing rollers 231 of Experiment Nos. 3 to 16, the above-mentioned conditions 1 to 3 were satisfied, which allowed a reliable separation of developer from the developing roller 231. Further, as shown in Table 1, the S1-pole and the S2-pole were permitted to have greatly different magnetic forces, which made it possible to allow the S2-pole to function as a draw-up magnetic pole and a regulating magnetic pole. Further, it was found that in the stationary magnet 231A of each of the developing rollers 231 of Experiment Nos. 3 to 16, a minimum value FR of the vertical component in the inter-pole region IE existed closer to the S2-pole than to the S1-pole (see FIGS. 4 to 7). As a result, re-adhesion of separated developer to the S2-pole was preferably prevented owing to the minimum value FR.

In addition, with regard to the second condition, it is more desirable that the flat area F (FIG. 4) of the horizontal magnetic force component extends over a range of 14 degrees or more in the rotational angle of the sleeve 231B. In this case, the magnetic attracting force acting on developer having passed over the S1-pole drops more suddenly, which allows a more reliable separation of developer from the sleeve 231B. This advantageous effect can be obtained, particularly in a developing roller 231 configured as a knurling roller and the like that has an outer portion formed with grooves extending in a longitudinal direction (axial direction). As shown in Table 2, in Experiment Nos. 8 to 16 in which the flat area F of the horizontal magnetic force component was set to extend over a range of 14 degrees or more, developer did not remain in the grooves. As described above, when the groove 231M (FIG. 11) has the wall extending along the normal line, a frictional force occurs owing to the horizontal magnetic force component, which causes a difficulty in separation of developer from the wall portion and re-conveyance of the developer in the groove 231M to the developing position. Therefore, even when a portion of developer is liable to adhere to the groove 231M owing to the horizontal magnetic force component in the inter-pole region IE, it is possible to allow a reliable separation of the developer from the sleeve 231B of the developing roller 231 by providing the flat area F of the horizontal component extending over a range of 14 degrees or more. Consequently, it is possible to prevent continuous adhesion of developer to the groove 231M.

In the above-described second condition according to the present disclosure, the flat area F of the horizontal magnetic force component is specified by the angle. It may appear that as the diameter of the developing roller 231 becomes smaller, the extent of the flat area F in the circumferential direction becomes smaller, which results in a deterioration in the developer separation. Actually, however, as the diameter of the developing roller 231 becomes smaller, the curvature of the developing roller 231 becomes smaller, which facilitates the developer separation. These effects cancel each other. Therefore, even if the developing roller 231 is designed to have a smaller diameter, satisfaction of the above-described conditions 1 to 3 will prevent a deterioration in the developer separation. Similarly, even if the developing roller 231 is designed to have a larger diameter, the same separation performance will be obtained.

The disclosures of the present disclosure have found, after a diligent analysis of the magnetic distributions of the developing rollers 231 of Example Nos. 3 to 16 that yielded evaluation results of image irregularities of Δ or ○, that it is possible to achieve a reliable developer separation also by satisfying the following condition in addition to the above-described conditions 1 and 2. Specifically, a reliable separation of developer can be achieved when the angular difference P (degrees) between a point M and a point Y with respect to a width Q (degrees) of the inter-pole region IE extending between the S1-pole and the S2-pole is 15% or less ($0<P/Q<0.15$), the point M lying on the downstream side of the maximum vertical component position of the magnetic force of the S1-pole in a conveyance direction at which the vertical magnetic force component is equal to 50% of the maximum value, and the point Y lying on the upstream side of the minimum horizontal component LP position in the conveyance direction in the inter-pole region IE at which the horizontal magnetic force component is higher than the minimum value by 0.5 mT.

It should be noted that in addition to the above-described Experiments, similar evaluations were performed after adjusting the gap (blade gap) between the layer thickness regulating member 232 and the developing roller 231 to allow the conveyance amount of developer on the sleeve 231B to fall within a range from 100 g/m2 to 400 g/m2, which yielded similar results indicating a suppression effect of image irregularities. Further, similar evaluations were performed after setting the toner density in a range from 5% to 12%, which yielded similar results indicating a suppression effect of image irregularities. Further, similar evaluations were performed with developing rollers 231 having a diameter in a range from 12 mm to 35 mm, and after setting the circumferential speed of the photoconductive drum 20 in a range from 200 mm/sec to 400 mm/sec, which yielded similar results indicating a suppression effect of image irregularities.

The developing device 23 according to the embodiment of the present disclosure and the image forming apparatus 10 including the same have been described in detail. The present disclosure, however, is not limited to the described configurations and, for example, the following modified embodiments may be adopted.

(1) In the above-described embodiment, the magnetic field serving to separate developer is produced between the S1-pole and the S2-pole on the stationary magnet 231A. However, the present disclosure is not limited to this configuration. It may be configured such that a similar magnetic field is produced between adjacent North poles.

(2) In the above-described embodiment, the developing roller 231 including the S1-pole and the S2-pole supplies toner to the photoconductive drum 20. However, the present disclosure is not limited to this configuration. Additional developing rollers may be disposed between the developing roller 231 and the photoconductive drum 20 so that developer is delivered by the plurality of rollers before toner is supplied to the photoconductive drum 20.

(3) Further, in the above-described embodiment, the S2-pole functions as a draw-up magnetic pole and a regulating magnetic pole. However, the present disclosure is not limited to this configuration. It may be configured such that the S2-pole functions as a draw-up magnetic pole and another magnetic pole lying downstream of (closer to the layer thickness regulating member 232 than) the S2-pole functions as a regulating magnetic pole.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developing device, comprising:

a housing for containing developer including toner and magnetic carrier;

a developing roller including a stationary magnet having a plurality of magnetic poles arranged in a circumferential direction, and a sleeve rotatable around the stationary magnet in a predetermined rotational direction and having a circumferential surface for carrying developer thereon, the developing roller being supported on the housing, while facing a photoconductive drum having a surface for allowing an electrostatic latent image to be formed thereon at a predetermined developing position, to supply toner to the photoconductive drum;

a developer stirring member rotatably supported on the housing, and operable to stir developer and supply developer to the developing roller; and a layer thickness regulating member disposed opposite to the sleeve of the developing roller for regulating the layer thickness of developer supplied to the developing roller by the developer stirring member, wherein:

the stationary magnet includes a first magnetic pole lying downstream of the developing position in the rotational direction and having a specific polarity, and a second magnetic pole lying downstream of the first magnetic pole in the rotational direction and having the same polarity as the first magnetic pole, the second magnetic pole producing a magnetic field that allows the sleeve to receive developer supplied by the developer stirring member;

in an entire inter-pole region between a maximum vertical component position of a magnetic force of the first magnetic pole and a maximum vertical component position of a magnetic force of the second magnetic pole, the stationary magnet produces a magnetic force including a horizontal component that keeps the specific polarity and has a value greater than zero (mT);

the inter-pole region includes a flat area where a horizontal magnetic force component having a minimum absolute value exits and the horizontal magnetic force component changes within a range of 0.5 (mT) or less, the flat area extending over a range of 10 degrees or more in a rotational angle of the sleeve; and when the maximum vertical magnetic force component of the first magnetic pole is A (mT), the half width of the vertical magnetic force component of the first magnetic pole is θ (degrees), the maximum vertical magnetic force component of the second magnetic pole is B (mT), and the half width of the vertical magnetic force component of the second magnetic pole is φ (degrees), the following relationship is satisfied:

$$2 \leq (B \times \varphi)/(A \times \theta) \leq 5.$$

2. The developing device according to claim 1, wherein the flat area extends over a range of 14 degrees or more in the rotational angle of the sleeve.

3. The developing device according to claim 2, wherein the sleeve of the developing roller has an outer portion formed with a plurality of grooves.

4. The developing device according to claim 1, wherein the second magnetic pole further produces a magnetic field that regulates the layer thickness of developer supplied to the developing roller in cooperation with the layer thickness regulating member.

5. The developing device according to claim 4, wherein the layer thickness regulating member is disposed below the developing roller, and the first magnetic pole lies above the second magnetic pole.

6. The developing device according to claim 5, wherein the first magnetic pole lies above an axis of the developing roller, and the second magnetic pole lies below the axis of the developing roller.

7. An image forming apparatus, comprising:

a developing device according to claim 1;

a photoconductive drum for receiving toner from the developing device and having a circumferential surface for carrying a toner image thereon; and a transfer section for transferring the toner image onto a sheet from the photoconductive drum.

* * * * *